US006715567B2

(12) United States Patent
Delgado et al.

(10) Patent No.: US 6,715,567 B2
(45) Date of Patent: Apr. 6, 2004

(54) APPARATUS AND METHOD FOR FORMING A PILOT HOLE IN A FORMATION

(75) Inventors: Steve R. Delgado, Houston, TX (US); Ken W. Winterrowd, Pearland, TX (US); Shane P. Hart, Wilaya de Ouargla (DZ)

(73) Assignee: Weatherford/Lamb, Inc., Houston, TX (US)

( * ) Notice: Subject to any disclaimer, the term of this patent is extended or adjusted under 35 U.S.C. 154(b) by 37 days.

(21) Appl. No.: 10/037,529

(22) Filed: Jan. 4, 2002

(65) Prior Publication Data

US 2002/0162658 A1 Nov. 7, 2002

Related U.S. Application Data

(60) Provisional application No. 60/288,252, filed on May 2, 2001.

(51) Int. Cl.[7] ..... E21B 7/08; E21B 29/06

(52) U.S. Cl. ..... 175/61; 175/80; 175/385; 175/425; 166/298; 166/117.6

(58) Field of Search ..... 166/298, 117.6, 166/55.7; 175/385, 426, 425, 61, 80, 81, 82

(56) References Cited

U.S. PATENT DOCUMENTS

| | | | | |
|---|---|---|---|---|
| 2,014,805 A | * | 9/1935 | Hinderliter | 166/55.3 |
| 5,109,924 A | | 5/1992 | Jurgens et al. | 166/117.5 |
| 5,429,187 A | | 7/1995 | Beagrie et al. | 166/55.1 |
| 5,445,222 A | | 8/1995 | Pritchard et al. | 116/298 |
| 5,592,991 A | | 1/1997 | Lembcke et al. | 166/298 |
| 5,636,692 A | | 6/1997 | Haugen | 166/298 |
| 5,647,436 A | | 7/1997 | Braddick | 166/298 |
| 5,657,820 A | | 8/1997 | Bailey et al. | 166/55.7 |
| 5,676,206 A | | 10/1997 | Rehbock et al. | 166/117.5 |
| 5,720,349 A | | 2/1998 | Pleasants et al. | 166/298 |
| 5,725,060 A | | 3/1998 | Blount et al. | 175/61 |
| 5,727,629 A | | 3/1998 | Blizzard, Jr. et al. | 166/298 |
| 5,743,331 A | | 4/1998 | Adkins et al. | 166/55.7 |
| 5,769,166 A | | 6/1998 | Duke | 166/298 |
| 5,771,972 A | | 6/1998 | Dewey et al. | 166/298 |
| 5,778,980 A | | 7/1998 | Comeau et al. | 166/298 |
| 5,787,978 A | | 8/1998 | Carter et al. | 166/117.6 |

(List continued on next page.)

FOREIGN PATENT DOCUMENTS

| | | | |
|---|---|---|---|
| GB | 2 334 734 A | 1/1999 | E21B/7/06 |
| WO | WO 99/36662 | 7/1999 | E21B/29/00 |

OTHER PUBLICATIONS

PCT International Search Report from PCT/GB 02/01795, Dated Aug., 06, 2002.

*Primary Examiner*—David Bagnell
*Assistant Examiner*—T Shane Bomar
(74) *Attorney, Agent, or Firm*—Moser, Patterson & Sheridan, L.L.P.

(57) ABSTRACT

The present invention generally provides an apparatus and method for forming a pilot hole in a formation. In one aspect of the present invention, the apparatus may comprise a starter mill connected to a bearing mill by a body joint. The apparatus may further comprise a lead bearing connected to a starter mill by a lead joint. Preferably, an outer diameter of the bearing mill is about the same as an inner diameter of a wellbore. As the lead bearing travels along the concave, the apparatus will bend between the bearing mill and the lead bearing. The bend urges the starter mill into contact with the wellbore wall. In another aspect of the present invention, a method for forming a pilot hole in a wellbore includes running a tool into the wellbore, the tool comprising a starter mill disposed between a first bearing and a second bearing. While running the tool along a concave of a whipstock, the tool bends between the first and second bearing and urges the starter mill to form the pilot hole.

37 Claims, 4 Drawing Sheets

U.S. PATENT DOCUMENTS

| | | | | | |
|---|---|---|---|---|---|
| 5,803,176 | A | | 9/1998 | Blizzard, Jr. et al. | 166/298 |
| 5,806,595 | A | | 9/1998 | Langford et al. | 166/298 |
| 5,806,596 | A | | 9/1998 | Hardy et al. | 166/298 |
| 5,826,651 | A | | 10/1998 | Lee et al. | 166/117.6 |
| 5,829,518 | A | | 11/1998 | Gano et al. | 166/55.7 |
| 5,832,997 | A | | 11/1998 | White et al. | 166/117.6 |
| 5,881,808 | A | | 3/1999 | Rehbock et al. | 166/117.5 |
| 5,887,655 | A | | 3/1999 | Haugen et al. | 166/298 |
| 5,887,668 | A | | 3/1999 | Haugen et al. | 175/79 |
| 5,894,889 | A | | 4/1999 | Dewey et al. | 166/298 |
| 5,944,101 | A | | 8/1999 | Hearn | 166/117.5 |
| 5,988,272 | A | * | 11/1999 | Bruce | 166/55.6 |
| 6,024,168 | A | | 2/2000 | Kuck et al. | 166/297 |
| 6,032,740 | A | * | 3/2000 | Schnitker et al. | 166/298 |
| 6,050,334 | A | | 4/2000 | McGarian et al. | 166/117.6 |
| 6,056,056 | A | | 5/2000 | Durst et al. | 166/298 |
| 6,102,123 | A | | 8/2000 | Bailey et al. | 166/313 |
| 6,109,347 | A | | 8/2000 | Ferguson et al. | 166/55.7 |
| 6,112,812 | A | | 9/2000 | Carter | 166/298 |
| 6,116,336 | A | | 9/2000 | Adkins et al. | 166/55.7 |
| 6,135,215 | A | | 10/2000 | Ericksen | 175/61 |
| 6,155,349 | A | | 12/2000 | Robertson et al. | 166/298 |
| 6,170,576 | B1 | | 1/2001 | Brunnert et al. | 166/298 |
| 6,186,233 | B1 | | 2/2001 | Brunet | 166/298 |
| 6,202,752 | B1 | | 3/2001 | Kuck et al. | 166/298 |
| 6,202,761 | B1 | | 3/2001 | Forney | 175/61 |
| 6,209,645 | B1 | | 4/2001 | Ohmer | 166/298 |
| 6,302,198 | B1 | | 10/2001 | Ritorto et al. | 166/55.1 |
| 6,318,466 | B1 | | 11/2001 | Ohmer et al. | 166/298 |
| 6,454,007 | B1 | * | 9/2002 | Bailey | 166/298 |
| 6,488,090 | B1 | * | 12/2002 | Ohmer | 166/298 |

* cited by examiner

APPARATUS AND METHOD FOR FORMING A PILOT HOLE IN A FORMATION

CROSS-REFERENCE TO RELATED APPLICATIONS

This application claims benefit of U.S. provisional patent application Ser. No. 60/288,252, filed May 2, 2001, which is herein incorporated by reference.

BACKGROUND OF THE INVENTION

1. Field of the Invention

The present invention generally relates to an apparatus for use in a well. Particularly, the invention relates to an apparatus for use in forming a lateral wellbore. More particularly, the invention relates to an apparatus for forming a pilot ledge to begin the formation of a lateral wellbore.

2. Description of the Related Art

Multilateral systems enable multiple reservoirs or areas within a reservoir to be produced simultaneously and offer the opportunity for reduced drilling and completion costs, increased production, and more efficient reservoir drainage. Multilateral technology connects a lateral wellbore or multiple lateral wellbores to a main borehole at the multilateral junction. The multilateral junction can be designed in a new well application or created in an existing wellbore in a re-entry application. These advances in drilling technology have made many vertical drilled wells candidates for re-entry and re-work to drill lateral wellbores.

Starting a lateral in a cased wellbore requires forming a pilot ledge in the wellbore tubular to provide direction and a pathway for a bit to begin the drilling operation. Because most bits are designed to drill at their bottom end surface, the pilot ledge is formed in the wellbore to create a contact surface for the bottom of the bit to initialize continuous drilling and minimize reaming of the bore. The drilling of the lateral starts as the bottom portion of the bit contacts this pilot ledge and proceeds along a path determined by a concave portion of a whipstock.

A conventional method used to create a pilot ledge in a cased wellbore begins with the setting of a packer or a bridge plug at a depth below the intended window of the lateral. Thereafter, a starter mill connected to a whipstock by a shearable connection is run into the wellbore. The starter mill typically includes a mill with a nose portion. Blades are disposed on the outer surfaces of the mill for cutting the pilot ledge. The nose portion connects the starter mill to the whipstock. The whipstock is set or fixed at a certain orientation to provide a directional guide for the starter mill. With the whipstock anchored to the packer, a shearing force is applied to the run-in string to detach the starter mill from the whipstock. The starter mill is then raised and rotated and proceeds to work back down along a concave face of the whipstock. The whipstock directs the starter mill to the opposing wall of the wellbore to begin cutting the pilot ledge. When the desired pilot ledge is cut, the starter mill is retrieved and a window mill is run-in to form a window shaped opening in the casing for a tri-cone bit to subsequently drill the lateral wellbore.

A conventional method of starting a lateral in an open hole does not require a pilot ledge. Instead, a whipstock is set above an open hole bottom at a depth below the intended window of the lateral. Then, cement is supplied to fill the wellbore above the whipstock. Once cured, the cement provides a drillable medium for a standard drilling bit to initiate drilling. As the drilling continues, the bit is guided by the concave face of the whipstock to form the lateral.

The above described method is generally effective when applied to an open hole adjacent to relatively softer formations. However, problems arise when this method is applied to open holes adjacent to abrasive and hard formations such as sandstone and quartzite. One problem caused by these hard borehole walls is severe wear and tear on the concave face of the whipstock which comes about as a result of the cutting tool's inability to penetrate the formation as it moves along the concave face of the whipstock. This problem is compounded by the fact that the sides of a bit generally are not designed to cut. Difficulty in cutting into the hard formation of the wellbore causes the bit to cut into the concave face of the whipstock. Consequently, the whipstock may have to be replaced before a lateral wellbore is formed.

One solution to the problem of hard borehole walls is to form a pilot ledge using the conventional method for a cased wellbore. However, the use of a starter mill presents the same problems, most notably, severe wear and tear on the whipstock as a result of the cutting tool's inability to penetrate the hard formation as the starter mill moves along the whipstock.

In addition to wear and tear, binding problems can also occur when conventional methods of forming a pilot ledge are applied to an open hole with hard formations therearound. Generally, a starting mill should have the same profile as a window mill or a bit that forms the lateral wellbore in order to leave an adequate clearance for the cutting tools that follow. When the formation is hard, continuous drilling may alter the profile of the starter mill. As a result, the pilot ledge formed will have a smaller diameter than the bit that follows. With its larger profile, the bit will bind and be forced to ream the pilot ledge to create a proper profile for itself. In the process, the bit may be damaged and its profile altered resulting in a wellbore that is not accessible by other tools.

Therefore, there is a need for an apparatus and methods to more effectively form lateral wellbores from hard, open-hole primary wellbores. There is a further need for an apparatus that can efficiently form a pilot ledge in a wellbore. There is yet a further need for a tool than can efficiently form a pilot ledge in an open hole wellbore adjacent a hard, abrasive formation.

SUMMARY OF THE INVENTION

The present invention generally provides an apparatus and method for forming a pilot hole in a formation. In one aspect of the present invention, the apparatus may comprise a starter mill connected to a bearing mill by a body joint. The apparatus may further comprise a lead bearing connected to a starter mill by a lead joint. Preferably, an outer diameter of the bearing mill is about the same as an inner diameter of a wellbore. As the lead bearing travels along the concave, the apparatus will bend between the bearing mill and the lead bearing. The bend urges the starter mill into contact with the wellbore wall.

In another aspect of the present invention, a method for forming a pilot hole in a wellbore includes running a tool into the wellbore, the tool comprising a starter mill disposed between a first bearing and a second bearing. While running the tool along a concave of a whipstock, the tool bends between the first and second bearing and urges the starter mill to form the pilot hole.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
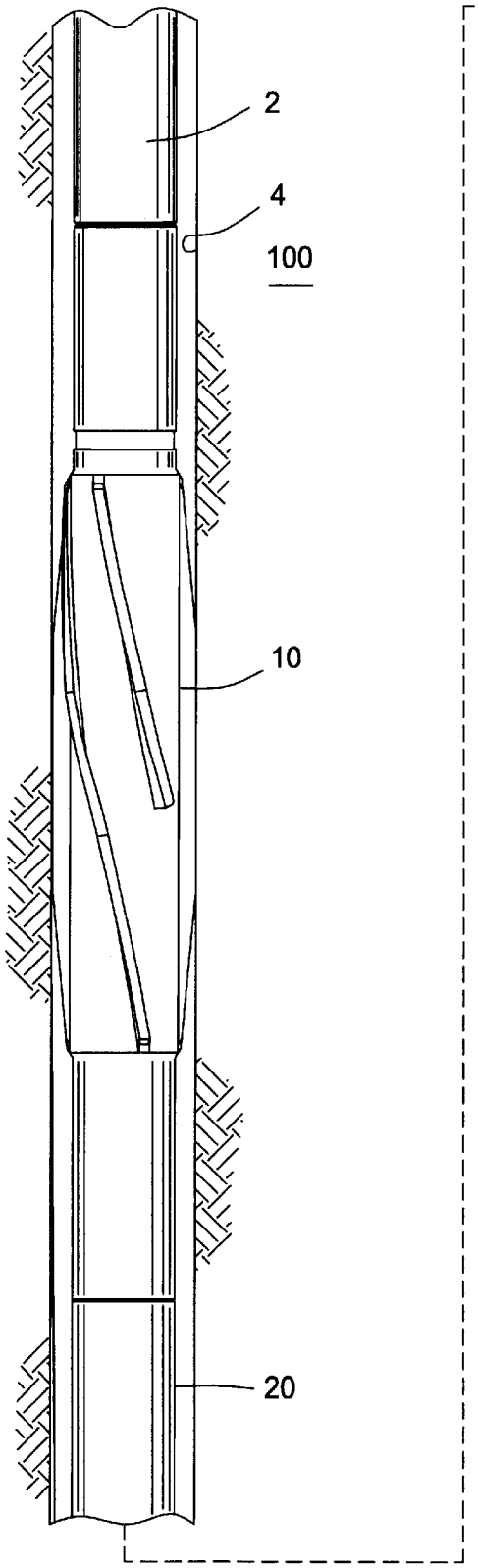
FIGS. 1A–B is a partial section view showing one aspect of the tool of the present invention in a wellbore.
Figure 1B:
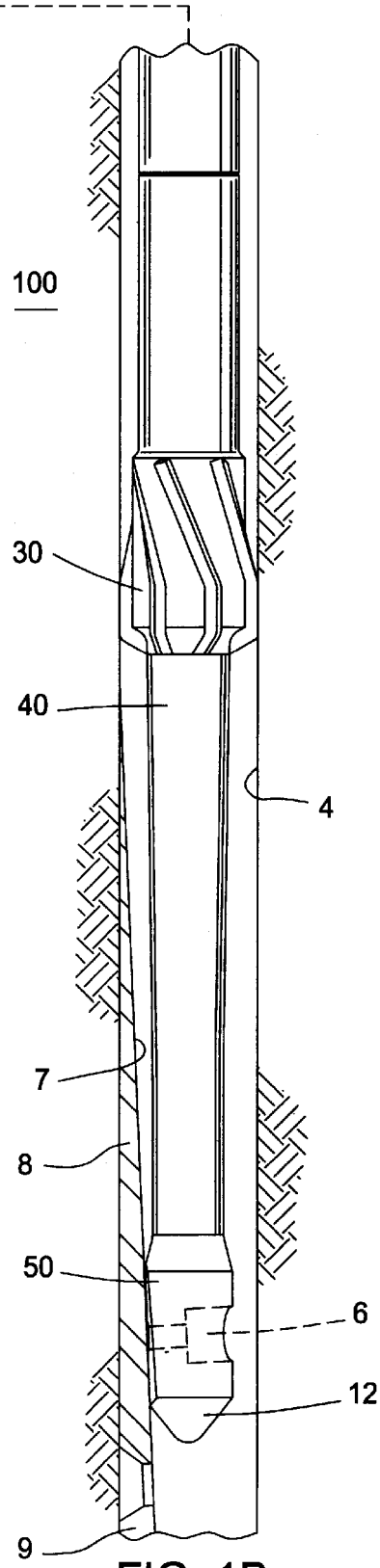

FIGS. 1A–B is a partial section view of a wellbore showing one aspect of the tool 100 according to the present invention. The tool 100 is disposed on a run-in string 2 in an open hole wellbore 4. A lower portion of the tool 100 (FIG. 1B) is disposed on a whipstock 8. A packer (not shown) is pre-placed below the intended window for a lateral wellbore prior to the run-in of the tool 100. In addition to providing an anchor for the whipstock 8, the packer seals the lower portion of the wellbore 4.

In one aspect of the present invention, the tool 100 comprises a bearing mill 10, a body joint 20, a starter mill 30, a lead joint 40, and a lead bearing 50. The bearing mill 10 is disposed at the upper end of the tool 100 adjacent to the run-in string 2. The bearing mill 10 provides a first bearing surface between the tool 100 and the wall of the wellbore 4. The outer diameter of the bearing mill 10 is substantially the same as the inner diameter of the wellbore 4 in order to center the upper portion of the tool 100 coaxially with the wellbore 4 as will be described herein. The outer surfaces of the bearing mill 10 may comprise smooth and/or rough outer surfaces. Preferably, the outer surface of the upper end of the bearing mill 10 comprises a smooth surface to facilitate the bearing relationship between the bearing mill 10 and the wellbore 4. The lower end of the bearing mill 10 is dressed with a rough surface, such as carbide, to provide any milling of the wellbore wall that may be necessary to avoid binding problems during rotation of the tool 100 in the wellbore 4. For example, as the lead bearing 50 moves along the concave face of the whipstock 8 and away from the centerline of the wellbore 4, the portion of the tool 100 between the lead bearing 50 and the bearing mill 10 is forced bend outward due to the outer diameter of the bearing mill 10 coinciding with the inner diameter of the wellbore 4. The bend force urges the lower portion of the bearing mill 10 against the wellbore wall. When this occurs, the rough surfaces at the lower portion of the bearing mill 10 cut into and remove wellbore material, thereby reducing any binding effect.

Preferably, the bearing mill 10 comprises a watermelon mill dressed with smooth and rough surfaces. In another embodiment, the outer surface of the bearing mill 10 may comprise all smooth surfaces. Alternatively, the bearing mill 10 may be round with all smooth surfaces. A round bearing mill 10 provides a bearing surface for tool 100 but does not have a lower portion that will cause binding problems.

The bending motion of the tool 100 between the lead bearing 50 and the bearing mill 10 is facilitated by a body joint 20 which provides flexibility to the tool 100 as it travels along the concave 7. One factor that determines the length of the body joint 20 is potential interference between the body joint 20 and the wellbore 4. As the tool 100 moves along the concave face of the whipstock 8 and the starter mill 30 cuts into the formation, the clearance between the body joint 20 and the wellbore 4 decreases. As a result, the size of the outer diameter of the body joint 20 is selected to maintain a clearance between the body joint 20 and the wellbore 4 throughout the milling process. Other factors that will determine the length of the body joint 20 will be discussed in more detail below. An example of a joint suitable for use as a body joint 20 is a pup joint.

Figure 5:
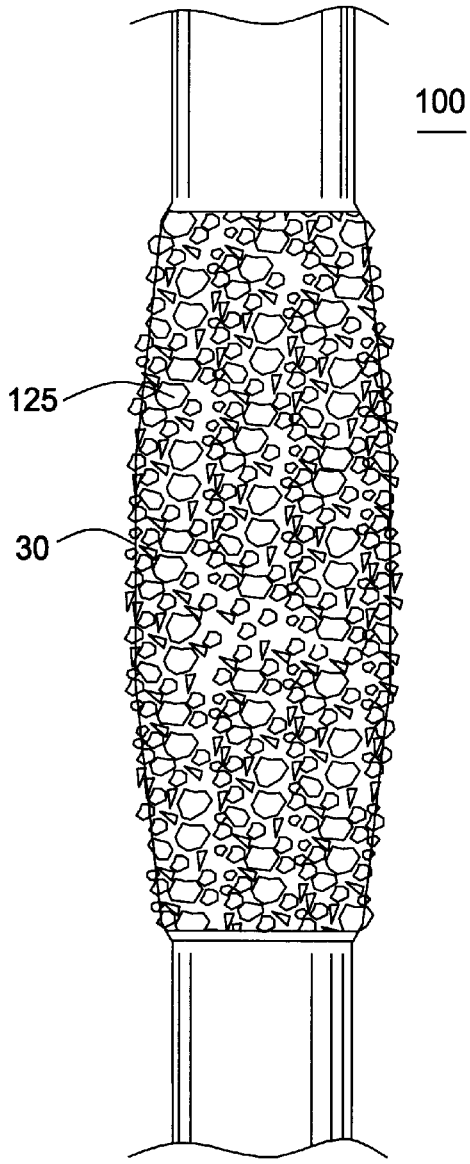
FIG. 5 illustrates another embodiment of the starter mill.
Figure 4:
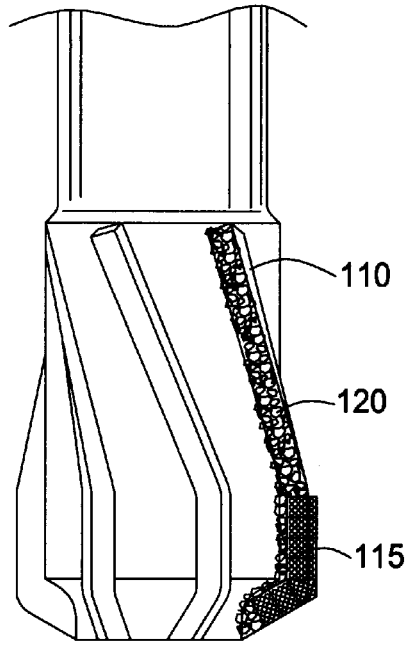
FIG. 4 illustrates a partial view of an embodiment of the starter mill.

As stated, the starter mill 30 is the tool component that forms the pilot ledge in the wellbore 4 and 30 should form a ledge profile that is appropriate for the bit that drills the lateral. Therefore, the outer diameter of the starter mill 30 is dictated by the size of the bit that follows. In one embodiment, blades 110 are formed around the starter mill 30. The leading edge of the blades 110 may be dressed with inserts 115, like tungsten carbide inserts, as shown in FIG. 4, which is a partial view of the starter mill 30. Additionally, crushed carbide 120 may be placed around the inserts 115 on the remaining portions of the blades 110. In another embodiment, the blades 110 may be dressed with crushed carbide 120 only. In another embodiment still, the starter mill 30 may be "bladeless," i.e., the starter mill 30 is dressed with a suitable cutting material 125 and is without a blade, as illustrated in FIG. 5. It is within the scope of this invention that any material suitable for cutting the particular formation may be used. These materials include natural diamond, polycrystalline diamond compact, thermally stable polycrystalline (TSP), cubic boron nitride, ceramic, and combinations thereof.

A lead joint 40 extends between the starter mill 30 and the lead bearing 50. Preferably, the outer diameter of the lead joint 40 is smaller than the outer diameter of the lead bearing 50, thereby preventing the lead joint 40 from coming into contact with the concave 7 during operation. The length of the lead joint 40 is such that when the lead bearing 50 is wedged between the wellbore 4 and the whipstock 8 and can't travel further, the starter mill 30 will have formed a pilot ledge of desired length and profile. In one embodiment of the present invention, the starter mill 30, lead joint 40, and lead bearing 50 are formed from one piece of steel with the mill blades added on as attachments. In another embodiment, the lead joint 40 has an outer diameter that tapers inward from the starter mill 30 to the lead bearing 50.

Because the lead bearing 50 is disposed at the lower end of the tool 100. It provides the second bearing surface between the tool 100 and the wellbore 4. Together, the lead bearing 50 and the bearing mill 10 control the direction of the starter mill 30 due to the position of those components with respect to the centerline of the wellbore 4. In the conventional method, the starter mill 30 will begin to cut into the concave 7 when it encounters a hard formation. The embodiments of the present invention place the starter mill 30 in minimum physical contact with the concave. Because the starter mill 30 is disposed between the two bearing surfaces (20, 40), the movement of the starter mill 30 is limited and directed by the bearing surfaces. Therefore, as the lead bearing 50 moves along the concave 7, the starter mill 30 must also remain substantially above the concave 7. This position allows the starter mill 30 to continuously be urged towards the wellbore 4 to form the pilot ledge, while minimizing damage to the concave 7. The position and the lateral movement of the starter mill 30 is controlled by balancing several factors including the length of the lead joint 40, the diameter of the lead bearing 50, and the length of the body joint 20. If a set of parameters such as the diameter of the wellbore 4, the incline of the whipstock 8, the size of the pilot ledge required, and the profile of the drilling bottom hole assembly that follows the starter mill 30 is known, these factors can be varied to find the proper design of the tool 100.

The outer diameter of the lead bearing 50 is also a factor in positioning the starter mill 30 and minimizing its contact with the concave 7. A proper lead bearing 50 outer diameter will keep any interaction between the starter mill 30 and the concave 7 at a minimum and avoid substantially damaging the whipstock 8 as the pilot hole is formed. The proper outer diameter must also ensure the appropriate pilot ledge is formed. At some point during the operation of the tool in the wellbore 4, the lead bearing 50 will wedge between the whipstock 8 and the wellbore 4 and prevent further advancement of the tool 100. Preferably, by the time the lead bearing 50 is wedged, a proper pilot hole will have been formed. For example, a lead bearing 50 with a large outer diameter may be effective in keeping the starter mill 30 off the face of the concave 7, but it may also prematurely wedge the lead bearing 50 between the concave 7 and the wellbore 4 and prevent the starter mill 30 from completing a proper pilot ledge. Therefore, the lead bearing 50 should be sized with an outer diameter to most effectively maintain minimal contact between the starter mill 30 and the concave 7 and avoid wedging between the whipstock 8 and the wellbore 4 before the appropriate pilot ledge is formed. Furthermore, some whipstocks 8 have a retrieving slot 9 in the concave for retrieving the whipstock 8. In those instances, the diameter of the lead bearing 50 must be larger than a width of the retrieving slot 9 to avoid the lead bearing 50 from being trapped in the retrieving slot 9.

The lead bearing 50 also serves as the point of attachment to the whipstock 8 as the tool 100 is run-in to the wellbore 4. Typically, the lead bearing 50 has a contact surface with the whipstock 8 having an incline that is about the same as the face angle of the whipstock 8. The similar angled inclines facilitate the attachment of the lead bearing 50 to the whipstock 8. For example, if a whipstock 8 with a three (3) degree face angle is used, the side of the lead bearing 50 in contact with the whipstock 8 should have about a three degree incline. The embodiments of the present invention may also be applied to whipstocks 10 with different face angles, including a conventional 1.92 degree face angle. Additionally, the radius of the contact surface may be about the same as the concave radius of the whipstock 8. The lead bearing 50 may also contain a bore 6 for insertion of a shearable member to attach the lead bearing 50 to the whipstock 8. Preferably, the angle of the bore is perpendicular to the incline of the lead bearing's 50 contact area with the whipstock 8. In addition, the lead bearing 50 may be attached to the whipstock 8 by other means known to one of ordinary skill in the art.

Figure 6:
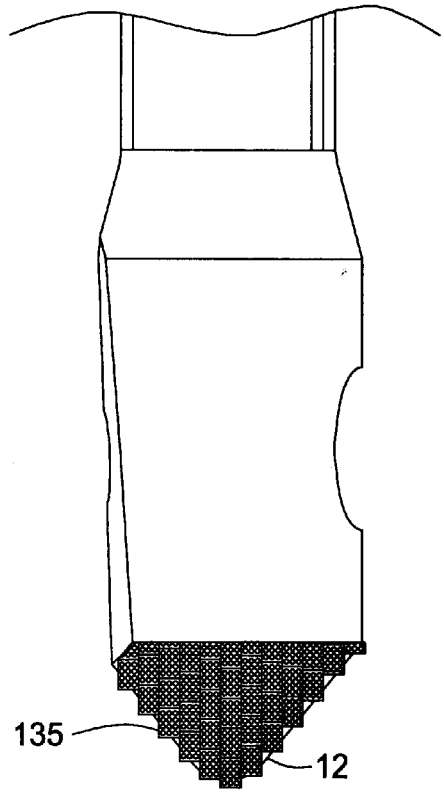
FIG. 6 illustrates an embodiment of the lead bearing.

The lead bearing 50 may further comprise a nose 12. Preferably, the nose 12 is shaped like a cone. The outer surface of the nose 12 may be a smooth surface or a rough surface having a cutting media 135, such as tungsten carbide inserts, as illustrated in FIG. 6.

In operation, the tool 100 is run into the wellbore 4 on a run-in string with the whipstock 8 attached below it. Preferably, the tool 100 is attached to the whipstock 8 by a shearable member at least partially disposed in the bore 6 of the lead bearing 50. The whipstock 8 is then anchored in a packer previously disposed in the wellbore 4 at a predetermined rotational altitude. A shearing force is applied to the tool 100 to shear it from attachment with the whipstock 8. Thereafter, the tool 100 can be rotated at the end of the run-in string.

Figure 2A:
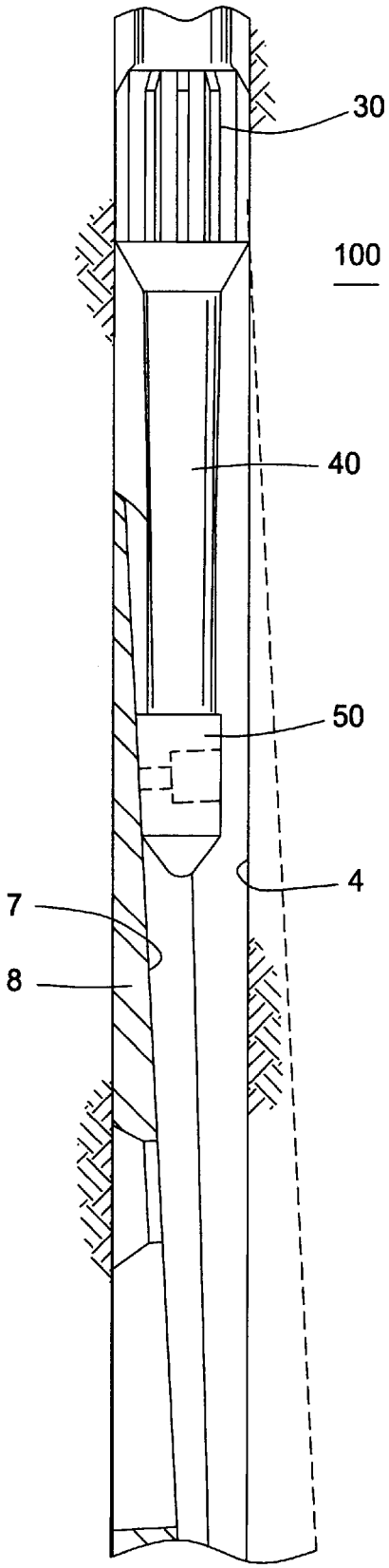
FIGS. 2A–C is a sequential schematic drawing of one aspect of the tool of the present invention in operation.

FIG. 2A illustrates a lower portion of the tool 100 in the wellbore 4 after the lead bearing 50 has been detached from the whipstock 8 and moved along the concave 7. The lead bearing 50 and the bearing mill (not shown) plot a millpath to guide the starter mill 30 to form the pilot ledge. The millpath is determined by the design of the tool 100 and the angle of the whipstock 8 used. Specifically, the section of the tool 100 between the lead bearing 50 and the bearing mill 10 (including the lead joint 40 and the body joint 20) will bend as the tool 100 moves along the concave 7. The bending action, as previously stated, is due to the position of the bearing mill 10 (in the centerline of the wellbore 4) and the position of the lead bearing 50 (outside the centerline as directed by the concave 7). The bend in the tool 100 forces the starter mill 30 into the wellbore wall to form the pilot ledge and also keeps any physical contact between the starter mill 30 and the concave portion of the whipstock 8 at a minimum.

Figure 2B:
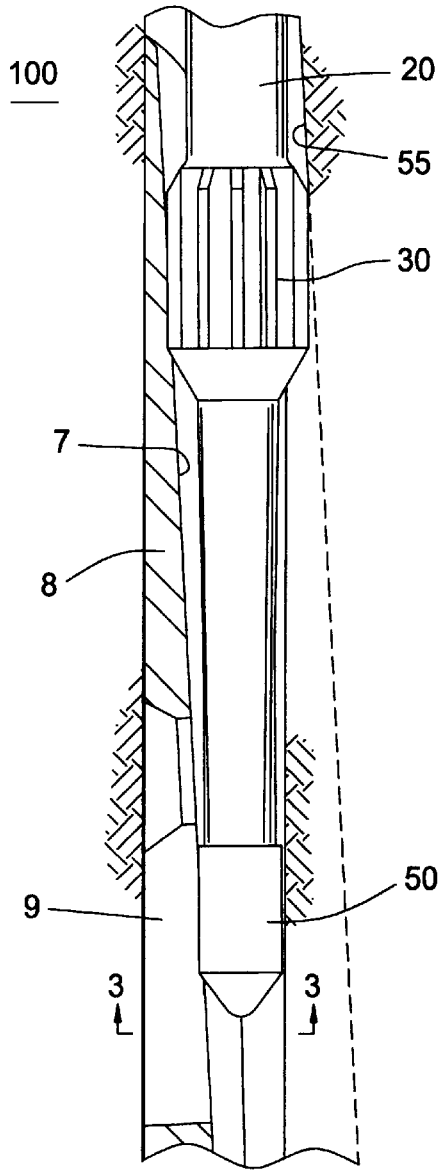

FIG. 2B illustrates a partial portion of the tool 100 after the lead bearing 50 has progressed down the concave and the starter mill 30 has created a small pilot hole 55. As shown, the starter mill 30 has moved onto the concave 7. The bend in the tool 100 created by the two bearings 10, 50 places the starter mill 30 in a position that minimizes any wear or tear on the concave 7 and maximizes the cutting of the pilot ledge 55. By placing the lead bearing 50 at a leading edge of the tool 100, the starter mill 30 is restricted from milling into the concave 7 when it encounters the hard formation. The bearings 10, 50 maintain the starter mill 30 in a position that allows the starter mill 30 to continuously work against the formation and form the pilot ledge 55 without substantially damaging the concave 7. As illustrated in FIG. 2B, a clearance still exists between the outer diameter of the body joint 20 and the wellbore 4.

Figure 3:
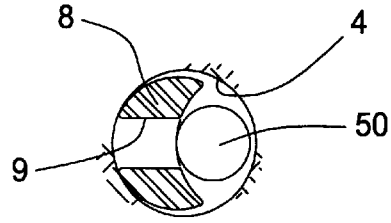
FIG. 3 is a schematic drawing of a cross-sectional view of the wellbore when the tool has moved above a retrieving slot of a whipstock.

As illustrated in FIG. 3, the lead bearing 50 is above the portion of the whipstock 8 where the retrieving slot 9 is located. The outer diameter of the lead bearing 50 is shown to be larger than the width of the whipstock's 8 retrieving slot 9. The larger diameter ensures that the lead bearing 50 will not be trapped in the retrieving slot 9 as it moves along the concave 7. Additionally, the lead bearing 50 may use the retrieving slot 9 as a guide to move along the concave 7.

Figure 2C:
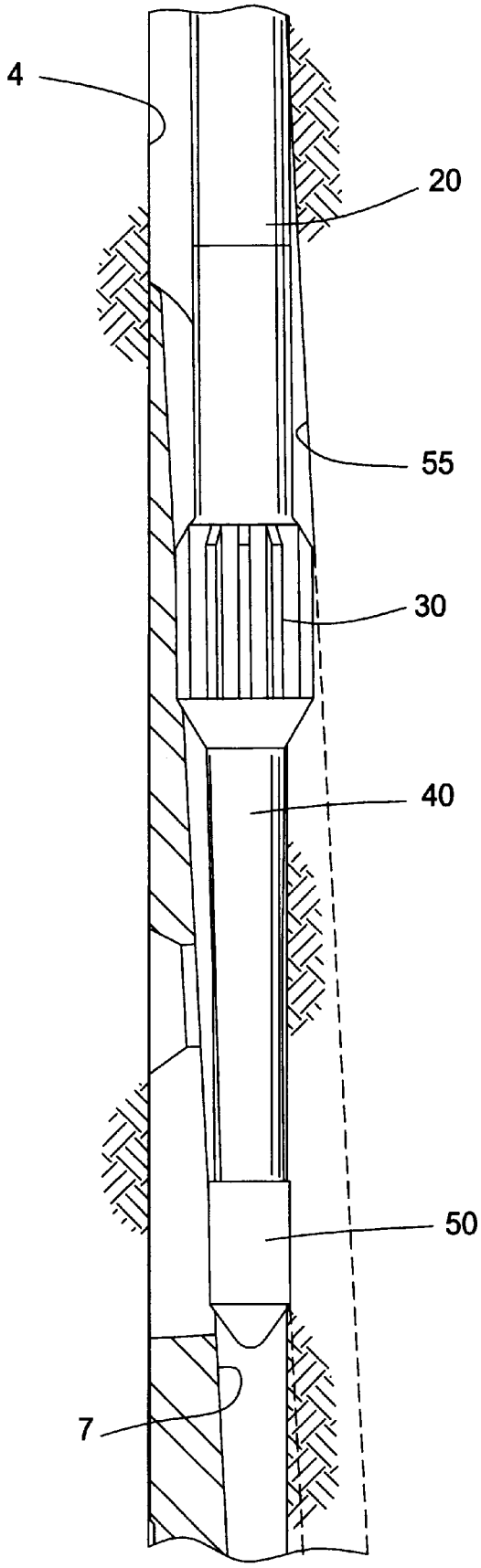

Referring to FIG. 2C, the lead bearing 50 is shown wedged between the whipstock 8 and the wellbore 4, thereby stopping movement of the tool 100. Also, the clearance between the body joint 20 and the wellbore 4 no longer exists. By this point, however, the proper pilot ledge 55 has been formed by the tool 100. With the operation completed, the tool 100 can be retrieved and the wellbore 4 ready for a bit to drill a lateral wellbore.

It must be noted that although the embodiments of the present invention are described in an open hole application, the aspects of the present invention can be equally applied to form a pilot ledge in other types of wellbores including a cased wellbore. Furthermore, in addition to whipstocks, the embodiments of the present invention may be used with other types of diverters generally known to a person of ordinary skill in the art.

EXAMPLE

One aspect of the present invention will be applied to create a pilot ledge for a lateral wellbore in an existing vertical wellbore. Specifically, the aspects of the present invention will be applied to an open hole wellbore with a 6 inch diameter having a hard formation. A whipstock with a three (3) degree face angle is used. A pilot ledge of at least 12 inches is needed to support the drilling bottom hole assembly that follows.

The tool used to create the appropriate pilot ledge is as follows. A watermelon mill with about a 6 inch outer diameter and about 12 inches in length was used as the bearing mill. The upper 6 inches of the outer surface remained smooth and the lower 6 inches was dressed with crushed carbide to form rough outer surfaces. The body joint comprises a pup joint having a 4.25 inch outer diameter and about 8 feet in length. The starter mill, lead joint, and lead bearing were formed from one piece of steel. The steel is about 51 inches in total length. The lead bearing is about 5 inches in length with an outer diameter of about 3.5 inches and has a cone shaped lower end. An incline of three degrees was also formed on one side of the lead bearing for attachment to the whipstock. Additionally, a bore perpendicular to the incline was formed in the lead bearing. The lead joint was about 19 inches in length and has an outer diameter of about 3.44 inches at the upper end and tapers to about 3.0 inches at the lower end. Six blades were attached to the starter mill section of the steel piece. The outer diameter of the starter mill was about 5.94 inches and has a profile that is suitable for the bit that drills the lateral wellbore. The length of the starter mill was about 7.5 inches. The blades were dressed with tungsten carbide inserts on the cutting edges with crushed carbide surrounding the remaining surfaces of the blades.

After shearing the tool from the whipstock, the tool was moved along the concave. Using the tip of the whipstock as a reference point, the first indication of torque against the wellbore experienced by the starter mill appeared at about 11 inches above the reference point. This is the instant where the starter mill begins to cut into the wellbore wall. At 13 inches below the reference point, the starter mill has cut about 0.925 inches into the formation. At this same instant, the lead bearing is traveling above the retrieving slot and simultaneously using it as a guide. Further, the body joint maintains a clearance between itself and the wellbore. It must be noted that the starter mill will cut into the concave slightly, but the damage to the whipstock is not so significant as to warrant a replacement whipstock. At 18 inches below the reference point, the lead bearing is wedged between the whipstock and the wellbore and cannot advance further. This is also the point where interference between the body joint and the wellbore wall begins to occur. The ledge profile at this point is at least 12 inches long and 1.15 inches into the formation, meeting the requirements for the drilling bottom hole assembly. The tool is then retrieved and a drilling bottom hole assembly is run-in to drill the lateral.

While the foregoing is directed to embodiments of the present invention, other and further embodiments of the invention may be devised without departing from the basic scope thereof, and the scope thereof is determined by the claims that follow.

What is claimed is:

1. An apparatus for use with a diverting apparatus to form a pilot ledge in a wellbore, comprising:

a bearing mill;

a starter mill;

a body joint connecting the starter mill to the bearing mill;

a lead bearing; and a lead joint connecting the lead bearing to the starter mill, wherein the bearing mill and the lead bearing act as pivoting points for the starter mill to urge the starter mill away from the diverting apparatus, thereby minimizing milling of the diverting apparatus.

2. The apparatus of claim 1, wherein an outer diameter of the bearing mill is about the same as an inner diameter of the wellbore.

3. The apparatus of claim 1, wherein an outer diameter of the lead joint is smaller than an outer diameter of the lead bearing.

4. The apparatus of claim 1, wherein an outer diameter of the lead bearing is larger than a width of a retrieving slot of a whipstock.

5. The apparatus of claim 4, wherein the bearing mill comprises smooth and rough outer surfaces.

6. The apparatus of claim 4, wherein the bearing mill comprises smooth surfaces.

7. The apparatus of claim 1, wherein the starter mill comprises one or more blades.

8. The apparatus of claim 7, wherein the starter mill further comprises one or more tungsten carbide inserts disposed on the one or more blades.

9. The apparatus of claim 8, wherein crushed carbides are disposed on the one or more blades.

10. The apparatus of claim 7, wherein the one or more blades comprise a cutting material selected from the group consisting of crushed carbide, natural diamond, polycrystalline diamond compact, thermal stable polycrystalline, cubic boron nitride, ceramic, and combinations thereof.

11. The apparatus of claim 1, wherein the starter mill comprises a bladeless mill.

12. The apparatus of claim 1, wherein the lead bearing comprises an incline surface that is about the same as a face angle of a whipstock.

13. The apparatus of claim 1, wherein the lead bearing comprises means for attachment to a whipstock.

14. The apparatus of claim 13, wherein the means for attachment comprise a bore in the lead bearing.

15. The apparatus of claim 1, wherein the lead bearing comprises a nose.

16. The apparatus of claim 15, wherein the nose comprises a smooth surface.

17. The apparatus of claim 15, wherein the nose comprises a cutting material selected from the group consisting of tungsten carbide inserts, crushed carbide, natural diamond, polycrystalline diamond compact, thermal stable polycrystalline, cubic boron nitride, ceramic, and combinations thereof.

18. The apparatus of claim 1, wherein an outer diameter of the lead bearing is larger than an outer diameter of the lead joint.

19. A tool for use with a diverter in a wellbore, comprising:

a first bearing member at an upper end of the tool, the first bearing member disposed on a tubular and sized with an outer diameter, whereby the tubular is substantially centered in the wellbore;

a second bearing member at a lower end of the tool, the second bearing member having an outer diameter substantially smaller than a diameter of the wellbore thereby permitting the bearing member to move out of a centerline of the wellbore as it travels along the diverter;

a cutting member disposed between the first and second bearing members, whereby the cutting member will be urged into a wall of the wellbore as the second bearing member moves along the diverter and wherein the first bearing member and the second bearing member act as pivoting points for the cutting member to urge the cutting member away from the diverter, thereby minimizing milling of the diverter.

20. The tool of claim 19, wherein the first bearing member comprises smooth and rough outer surfaces.

21. The tool of claim 20, wherein the first bearing member comprises a watermelon mill.

22. The tool of claim 19, wherein the cutting member comprises at least one blade dressed with rough surfaces.

23. The tool of claim 19, wherein the cutting member comprises a bladeless mill.

24. The tool of claim 19, wherein the outer diameter of the second bearing member is larger than a width of a retrieving slot.

25. The tool of claim 19, further comprising:

a first joint member connecting the first bearing member to the cutting member; and a second joint member connecting the second bearing member to the cutting member.

26. The tool of claim 25, wherein an outer diameter of the second joint member is smaller than the outer diameter of the second bearing member.

27. The tool of claim 25, wherein the first bearing member comprises smooth and rough outer surfaces.

28. The tool of claim 25, wherein the cutting member comprises at least one blade dressed with rough surfaces.

29. The tool of claim 25, wherein the cutting member comprises a bladeless mill.

30. The tool of claim 25, wherein the outer diameter of the second bearing member is larger than a width of a retrieving slot.

31. The tool of claim 30, wherein the outer diameter of the second bearing member is larger than an outer diameter of the lead joint.

32. The tool of claim 25, wherein the diverter is a whipstock.

33. A method for forming a pilot hole in a wellbore, comprising:

running a tool into the wellbore, the tool comprising a starter mill disposed between a first bearing and a second bearing;

moving the first bearing along a concave;

pivoting the starter mill between the first bearing and the second bearing to urge the starter mill against a wall of the wellbore, wherein the first bearing is adapted to minimize contact between the starter mill and the concave thereby minimizing milling of the concave; and forming the pilot hole.

34. The method of claim 33, further comprising causing the tool to bend between the first and second bearings.

35. The method of claim 34, wherein the starter mill has an outer diameter greater than an outer diameter of the first bearing.

36. The method of claim 33, wherein the second bearing has an outer diameter greater than a width of a retrieving slot.

37. An apparatus for forming a pilot ledge in a wellbore, comprising:

a bearing mill;

a starter mill;

a body joint connecting the starter mill to the bearing mill;

a lead bearing having a nose, wherein the nose comprises a cutting material selected from the group consisting of tungsten carbide inserts, crushed carbide, natural diamond, polycrystalline diamond compact, thermal stable polycrystalline, cubic boron nitride, ceramic, and combinations thereof; and a lead joint connecting the lead bearing to the starter mill.

* * * * *